US008720734B2

(12) United States Patent
Malcolm et al.

(10) Patent No.: US 8,720,734 B2
(45) Date of Patent: May 13, 2014

(54) PLATE WITH FEATURES THAT COOPERATIVELY INTERACT WITH UTENSILS

(76) Inventors: Carter T. Malcolm, Ann Arbor, MI (US); Jacqueline K. Malcolm, Ann Arbor, MI (US)

( * ) Notice: Subject to any disclaimer, the term of this patent is extended or adjusted under 35 U.S.C. 154(b) by 0 days.

(21) Appl. No.: 12/953,574

(22) Filed: Nov. 24, 2010

(65) Prior Publication Data

US 2011/0068111 A1 Mar. 24, 2011

Related U.S. Application Data

(63) Continuation of application No. 12/080,771, filed on Apr. 7, 2008, now abandoned.

(51) Int. Cl.

| | |
|---|---|
| ***A47G 19/00*** | (2006.01) |
| ***B65D 21/02*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |
| ***A47G 21/00*** | (2006.01) |
| ***A47G 23/00*** | (2006.01) |
| ***A47G 19/02*** | (2006.01) |

(52) U.S. Cl.

USPC ..... 220/574.1; 220/556; 220/574; 220/575; 220/608; 220/23.8

(58) Field of Classification Search

USPC ..... 220/574, 574.1, 608, 556, 23.8, 575

See application file for complete search history.

(56) References Cited

U.S. PATENT DOCUMENTS

| | | | | |
|---|---|---|---|---|
| 2,352,684 | A * | 7/1944 | Braddock | 220/23.6 |
| 4,863,033 | A | 9/1989 | Buj | |
| 4,986,434 | A | 1/1991 | Prestyly, Jr. | |
| 5,172,826 | A | 12/1992 | Celaya | |
| 5,341,953 | A * | 8/1994 | Forester | 220/575 |
| 5,390,816 | A | 2/1995 | Boyd | |
| 5,588,551 | A | 12/1996 | Morrow et al. | |
| 5,638,981 | A | 6/1997 | Crane et al. | |
| 5,887,749 | A * | 3/1999 | Schommer et al. | 220/575 |
| 5,938,066 | A | 8/1999 | DeMars | |
| 7,874,449 | B1 * | 1/2011 | Studee et al. | 220/502 |

* cited by examiner

*Primary Examiner* — Fenn Mathew
*Assistant Examiner* — Andrew T Kirsch
(74) *Attorney, Agent, or Firm* — Briks Gilson & Lione

(57) ABSTRACT

A food serving plate with features that cooperatively interact with utensils to provide fun assistance to children with their effort to load food onto their utensils. The features on the plate include either or both of: a vertically slotted ramp that accepts the tines of an eating utensil, such as a fork, which allows a person to load food onto the utensil by pushing the food up the ramp and then sliding the utensil under the food when it has reached sufficient height; and a ramp with a nested depression that accepts the leading perimeter contours of a utensil with a food-receiving bowl, such as a spoon, which allows a person to load food onto the utensil by positioning the utensil within the nested depression and by pushing the food up the ramp and over the nested depression with a second utensil with a blunt profile, such as a pusher.

14 Claims, 6 Drawing Sheets

PLATE WITH FEATURES THAT COOPERATIVELY INTERACT WITH UTENSILS

RELATED APPLICATIONS

This application is a continuation of U.S. patent application Ser. No. 12/080,771, filed Apr. 7, 2008, now abandoned and entitled "PLATE WITH FEATURES THAT COOPERATIVELY INTERACT WITH UTENSILS," the entire contents of which is incorporated herein by reference.

BACKGROUND

1. Field of the Invention

The present invention relates to food serving devices. More particularly, it pertains to an individual food serving plate that is designed to be used by children to facilitate their independent use of utensils.

2. Description of the Prior Art

Many parents struggle to get their children to eat independently with utensils. Prior art exists that has special forms of dinnerware that seek to address this problem by either making the dinnerware entertaining or by offering features that interact with utensils. For example, U.S. Pat. Nos. 5,938,066 and 4,863,033 disclose food serving plates on which utensils can be mounted; the plates and utensils in these disclosures encourage children to eat by using decorations and/or entertaining toy figures that seek to make eating fun. U.S. Pat. No. 4,986,434 discloses a dish that contains a cavity that helps users load string-form pasta onto a utensil by spinning the utensil within the cavity. U.S. Pat. Nos. 5,390,816 and 5,588,551 disclose plates with abutments that are used to force food pushed against the side wall by a utensil onto the utensil. U.S. Pat. No. 5,638,981 discloses a plate hollowed out recess in the bottom that is located at or below the food-receiving surface of the plate and has a lip that overlaps and engages an edge of a utensil, such as a spoon, so that the utensil is retained within the recess and food can be smoothly slid from the plate onto the utensil.

The present invention offers a different solution to get children to eat independently with utensils than that presented by the prior art. The present invention offers features that appeal to children because the features are not only fun, but also because the features interact with utensils to assist children's efforts to load food onto utensils. Additionally, the geometry of the features in the present invention differs from the geometry of the features disclosed in the prior art.

Known prior art includes U.S. Pat. Nos. 4,863,033; 4,986,434; 5,172,826; 5,390,816; 5,588,551; 5,638,981; and 5,938,066.

BRIEF SUMMARY

The general purpose of the present invention, which will be described subsequently in greater detail, is to provide a food serving plate with features that cooperatively interact with utensils to offer a young child fun assistance with their efforts to load food onto utensils.

The food serving plate may include a sloped ramp that leads to a nested depression that is elevated from the main surface of the plate. The nested depression is sized to snugly accept the leading perimeter of a utensil with a food-receiving bowl, such as a spoon. An individual using the plate can load food onto the bowl of the utensil using this feature. The individual would do so by holding the utensil with the bowl placed within the nested depression. With the utensil in place, the individual would use their other hand to manipulate the food up the ramp using a blunt utensil, such as a pusher, or other specifically configured implement. Upon reaching the top of the ramp, the individual would continue to manipulate the food over the nested depression with the blunt utensil. The food will fall from the elevated ramp onto the bowl of the utensil that is held within the nested depression. The individual may then lift the utensil to eat the food.

The general purpose of the present invention, which will be described subsequently in greater detail, is to provide a food serving plate with features that cooperatively interact with utensils to offer a young child fun assistance with their efforts to load food onto utensils.

The food serving plate may include a sloped ramp that leads to a nested depression that is elevated from the main surface of the plate. The nested depression is sized to snugly accept the leading perimeter of a utensil with a food-receiving bowl, such as a spoon. An individual using the plate can load food onto the bowl of the utensil using this feature. The individual would do so by holding the utensil with the food-receiving bowl within the nested depression. With the utensil in place, the individual would use their other hand to manipulate the food up the ramp using a blunt utensil, such as a pusher, or other specifically configured implement. Retaining walls may run lengthwise along either or both sides of the ramp. The retaining walls are designed to prevent food from sliding off of the sides of the ramp as the blunt utensil pushes the food up the ramp. Upon reaching the top of the ramp, the individual would continue to manipulate the food over the nested depression with the blunt utensil. The food will fall from the elevated ramp onto the bowl of the utensil that is held within the nested depression. The individual may then lift the utensil to eat the food.

The food serving plate may include a vertically slotted ramp. The vertical slots in the ramp are designed to accept the tines of an eating utensil, such as a fork. The slotted ramp 'may lead to a vertical or sloped wall at the end of the ramp. An individual using the plate can load food onto the utensil using this feature. The individual would push food over to the slotted ramp with the utensil. The individual would align the tines of the utensil with the vertical slots in the ramp and then push the food toward the slotted ramp with the utensil. As the utensil progresses into the slotted ramp, the utensil pushes the food up the ramp and the tines of the utensil slide into the vertical slots in the ramp. Once the food is sufficiently elevated on the ramp to clear the top of the tines of the utensil, the utensil will slide under the food. When the utensil is sufficiently positioned under the food, the individual can lift the fork upward through the vertical slots in the ramp thereby removing it from the slotted ramp and loading the food on the utensil. A vertical or sloped wall may provide assistance as a backstop to prevent large food items from being pushed over the top of the ramp by the utensil. Retaining walls may run lengthwise along either or both sides of the slotted ramp. The retaining walls are designed to prevent food from sliding off of the sides of the slotted ramp as the utensil pushes the food up the ramp.

The food serving plate may include both of the previously described features: a sloped ramp with that leads to a nested depression that is elevated from the main surface of the plate; and a vertically slotted ramp.

While other prior art discloses features that assist individuals with loading food onto utensils, none do so with the same elements as disclosed within the present invention. Prior art exists that discloses a hollowed out recess that accepts a spoon to facilitate the loading of food onto the spoon. The hollowed out recess in the prior art is positioned below the main eating surface of the plate and has an overlapping lip that will allow the utensil to be cantilevered and retained in the recess. The present invention differs from this and other prior art in several ways: the present invention uses a combination of a ramp and a nested depression to load food onto a spoon; the present invention uses a nested depression which snugly accepts the leading perimeter of the spoon, but does not snugly receive the bowl of the spoon; the present invention does not use an overlapping lip to engage, cantilever and retain the spoon within the nested depression; the present invention uses a nested depression that is below the top of the ramp, but not below the main eating surface of the plate; the present invention uses retaining walls that run lengthwise along the ramp to prevent food from falling off the sides of the ramp. Prior art also exists that offers a horizontally slotted ramp to load food onto a spoon or fork. The present invention differs from this and other prior art in several ways: the present invention uses a vertically slotted ramp and does not use a horizontally slotted ramp or abutment with a side wall; the objective of the present invention is to load food onto a utensil by allowing the tines of a utensil to slide within the vertically slotted ramp and under the food, whereas the objective in the prior art is to load food onto a utensil by pressing the food and utensil against the side wall of the abutment or horizontally slotted ramp; the present invention uses retaining walls that run lengthwise on either side of the vertically slotted ramp to keep food on the ramp as it is pushed up the ramp by the utensil; the present invention uses a vertically slotted ramp that is not removable from the plate.

The features of the present invention will become apparent from the following detailed description considered in connection with the accompanying drawing. It is to be understood, however, that the drawing is designed as an illustration only and not as a definition of the limits of the invention.

DETAILED DESCRIPTION OF THE DRAWINGS AND THE PRESENTLY PREFERRED EMBODIMENTS

Figure 1:
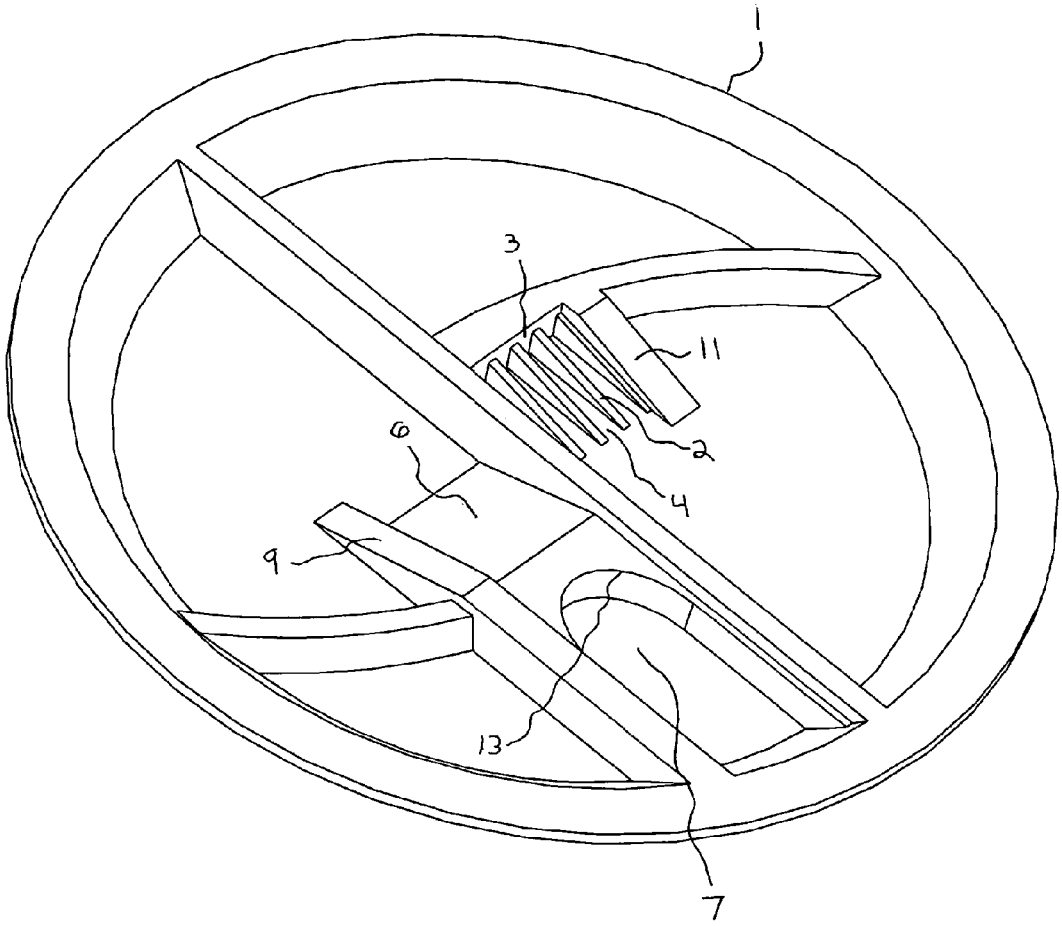
FIG. 1 is a perspective view of a preferred embodiment of a food serving plate formed in accordance with this invention.
Figure 7:
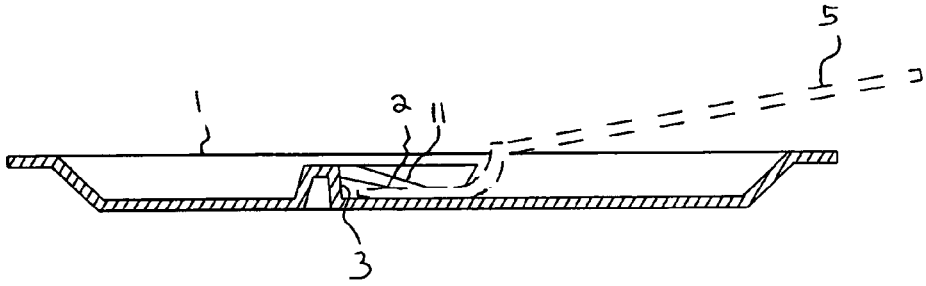
FIG. 7 is a sectional view of the food serving plate taken along the lines 7-7 of FIG. 4.
Figure 8:
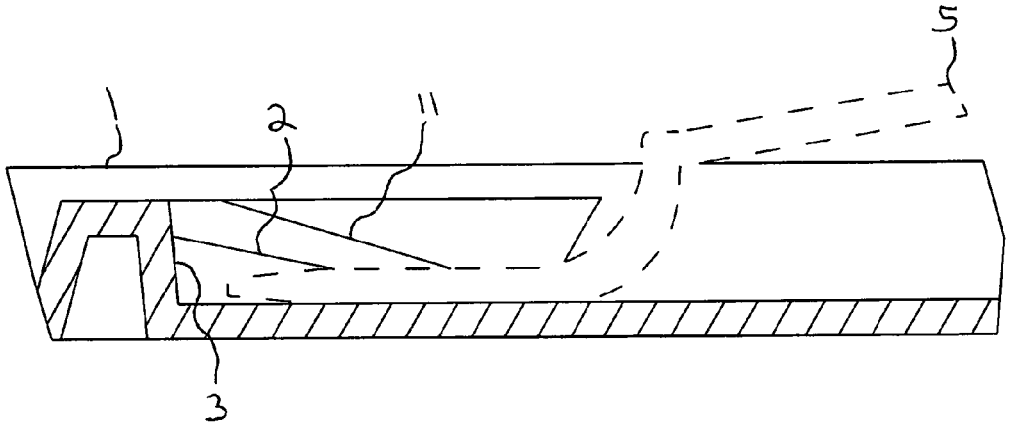
FIG. 8 is an enlarged fragmented sectional view of the slotted ramp in the plate.

Referring to the drawings, there is shown in FIG. 1 a preferred embodiment of a plate 1 formed in accordance with this invention. The plate 1 includes a ramp 2 that may lead to a vertical or sloped wall 3. The ramp 2 has multiple slots 4. The width and number of slots 4 present are configured to accept the tines of an eating utensil 5, such as a fork (shown in phantom). The length and angle of the ramp 2 are sized to allow the height of the ramp 2 at the top of its slope to be greater than or equal to the height of the tines of the utensil 5 (as best shown in FIG. 7 and FIG. 8). The height of the wall 3 should sufficiently extend above the top height of the ramp 2 to retain any food items when the utensil 5 manipulates the food up the ramp 2. The ramp 2 may be bound on either side by a raised ridge 11. The ridges 11 should be taller than the height of the ramp 2 to a sufficient extent to retain any food items that the utensil 5 is manipulating up the ramp 2.

Referring to the drawings, there is shown in FIG. 1 a preferred embodiment of a plate 1 formed in accordance with this invention. The plate 1 includes a ramp 2 that may lead to a vertical or sloped wall 3. The ramp 2 has multiple vertical slots 4. The width and number of vertical slots 4 present are configured to accept the tines of eating utensils, such as a fork (shown in phantom). The length and angle of the ramp 2 are sized to allow the height of the ramp 2 at the top of its slope to be greater than or equal to the height of the tines of the utensils (as best shown in FIG. 7 and FIG. 8). The height of the wall 3 should sufficiently extend above the top height of the ramp 2 to retain any food items when the utensils manipulate the food up the ramp 2. The ramp 2 may be bound on either or both sides by a raised retaining wall 11. The retaining walls 11 should be taller than the height of the ramp 2 to a sufficient extent to keep any food items that the utensil 5 is manipulating up the ramp 2 on the ramp 2.

Figure 2:
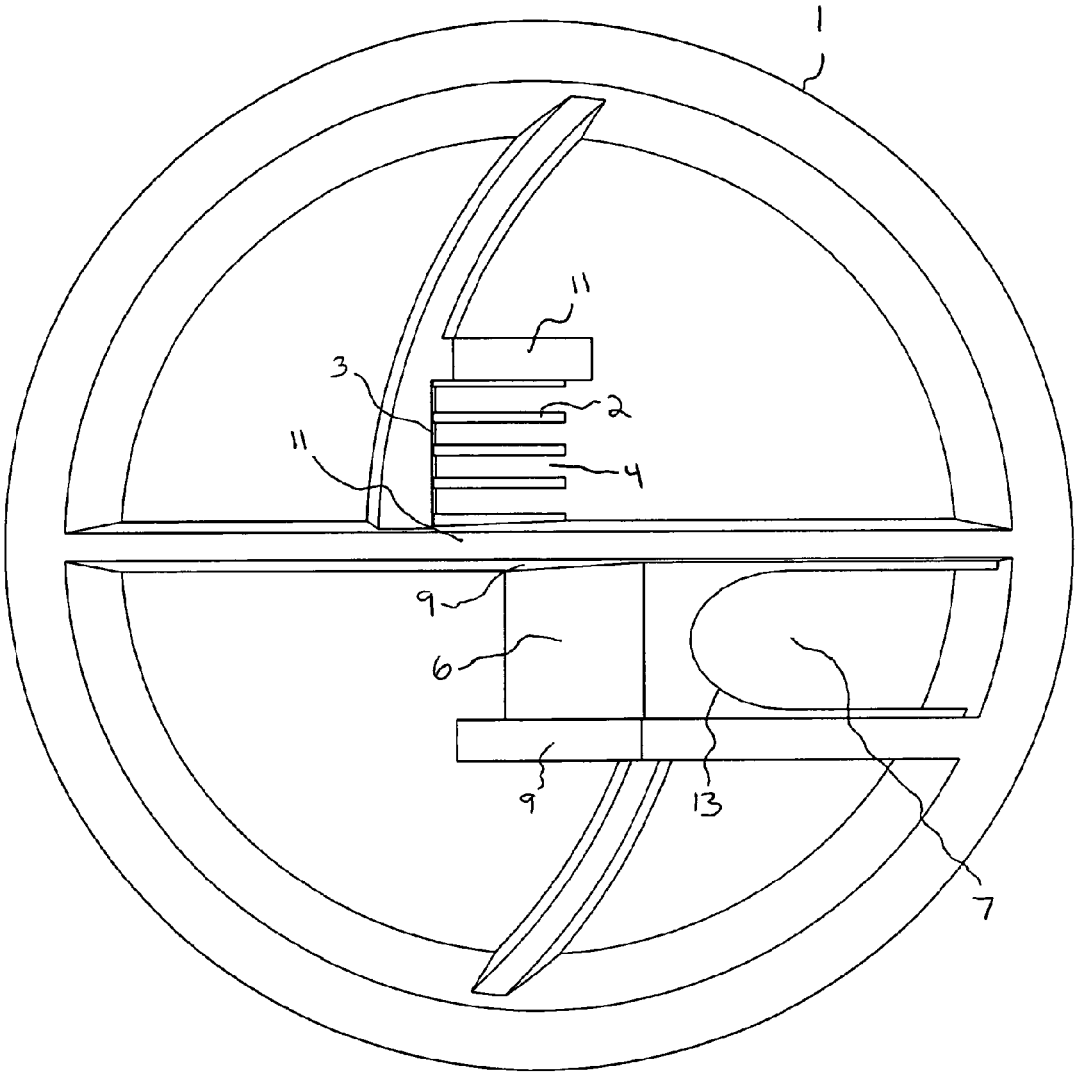
FIG. 2 is a top plan view of the food serving plate of FIG. 1.
Figure 3:
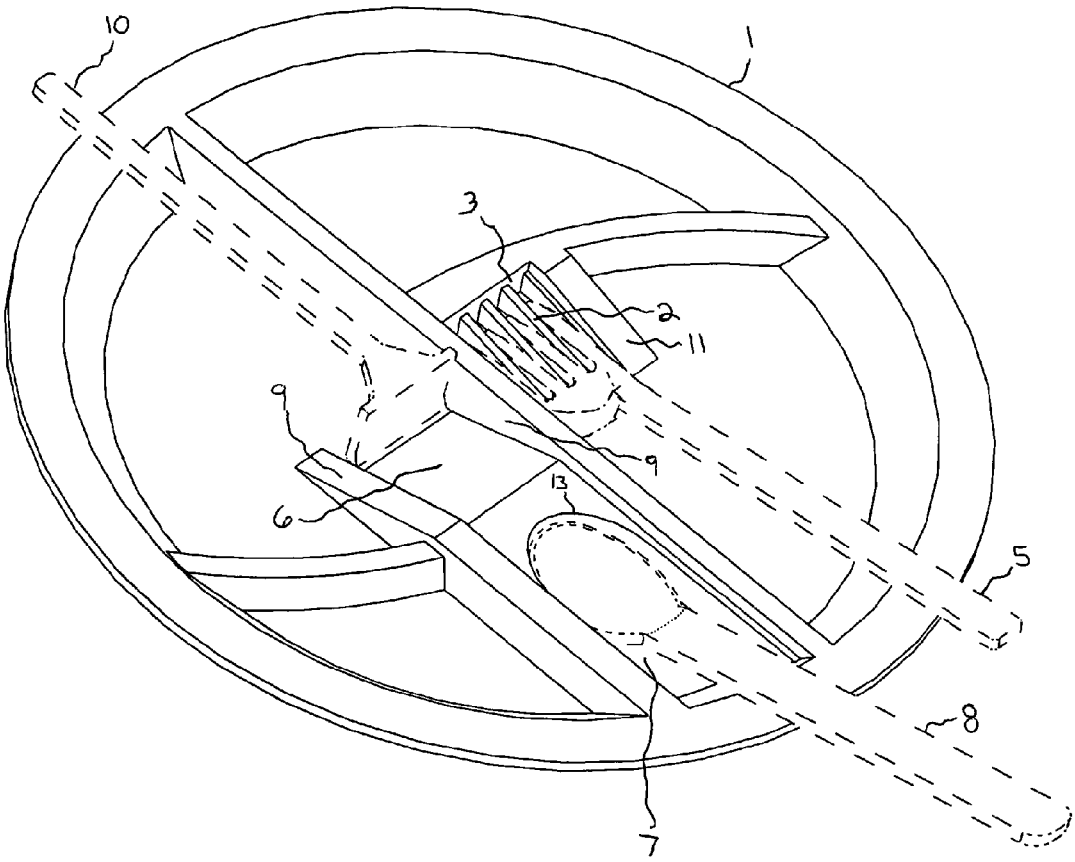
FIG. 3 is a perspective view of the food serving plate of FIG. 1 with the addition of a fork, spoon and pusher.
Figure 4:
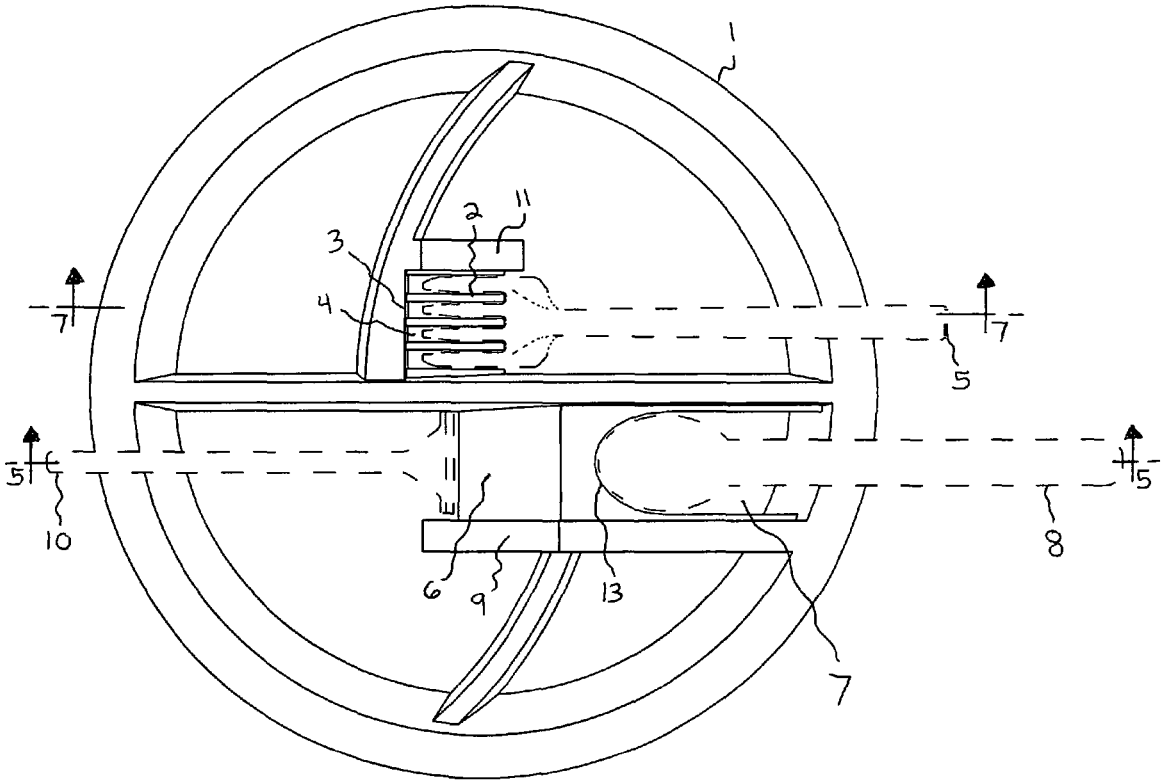
FIG. 4 is a top plan view of the food serving plate of FIG. 3 with the addition of a fork, spoon and pusher.
Figure 5:
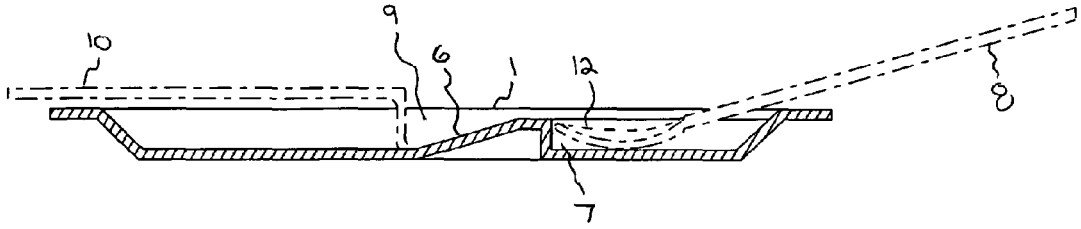
FIG. 5 is a sectional view of the food serving plate taken along the lines 5-5 of FIG. 4.
Figure 6:
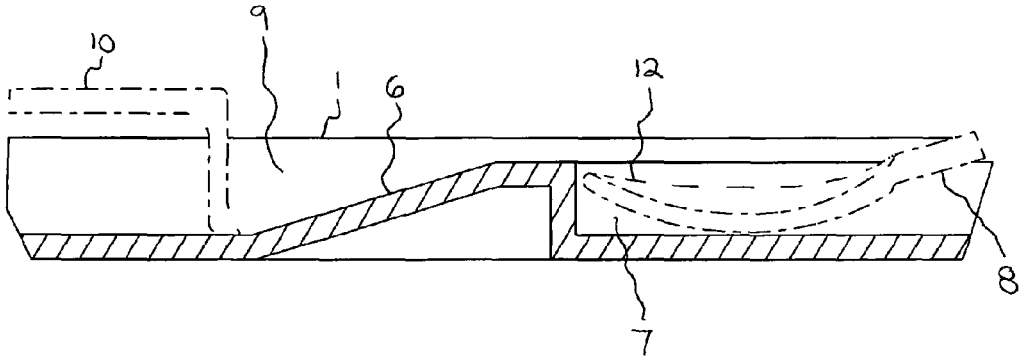
FIG. 6 is an enlarged fragmented sectional view of the ramp and nested depression in the plate.

The plate 1 also includes a ramp 6 that leads to a nested depression 7 that is sized to snugly accept the leading perimeter of a utensil with a food-receiving bowl 8, such as a spoon (shown in phantom). The ramp 6 may be bound on either side by retaining walls 9 (as best shown in FIG. 2 and FIG. 4) that are sized to accept the contours of a blunt utensil 10, such as a pusher (shown in phantom). The retaining walls 9 should be elevated above the ramp 6 to a sufficient extent to keep any food items that the blunt utensil 10 is manipulating up the ramp 6 on the ramp 6. The height of the ramp 6 should be sufficient so that the top of the bowl 12 of the utensil 8 will be below the top surface 13 of the ramp 6 when the utensil 8 is positioned within the nested depression 7 (as best shown in FIG. 5 and FIG. 6). The nested depression 7 should have sufficient perimeter contours 13 to allow an individual to properly position the bowl 12 of the utensil 8 so that food items manipulated over the ramp 6 will be deposited onto the bowl 12 of the utensil 8.

It is possible to make the plate from any suitable material or combination of materials and it can be manufactured in many different sizes and in one or many colors.

Many changes and variations of the disclosed embodiments of the present invention may be made without departing from the spirit and scope of the inventive concept. Such changes, modifications and rearrangements are deemed readily apparent and obvious to one skilled in the art and all equivalent relationships to those illustrated in the figures and described in the specification are intended to be encompassed by the present invention. The present invention is not intended to be limited otherwise than as required by the appended claims.

The invention claimed is:

1. A plate comprising:

a lower surface;

a lip formed about a periphery of the plate extending upwardly from the lower surface;

an upper surface located above the lower surface and including a first side and a second side;

an incline extending from the lower surface of the plate to the first side of the upper surface, the incline defining a surface having a width, wherein the incline defining the surface is substantially flat;

a wall section extending from the second side of the upper surface to the lower surface of the plate, the wall section being substantially perpendicular to the upper surface and the lower surface of the plate; and wherein the wall section defines a cavity configured to receive a spoon, wherein a width of the cavity is substantially similar to the width of the surface of the incline and a width of the upper surface.

2. The plate of claim 1, wherein the wall section defines a curved profile substantially matching that of a spoon.

3. The plate of claim 1, wherein the cavity extends between the wall section and an outer periphery.

4. The plate of claim 1, wherein the angle of the incline between the lower surface and the first side of the upper surface is less than the angle between the lower surface and the top portion of the lip.

5. The plate of claim 1, further comprising a first wall positioned directly adjacent to the incline and rising above at least a portion of the incline surface.

6. The plate of claim 5, wherein the first wall extends across the lower surface of the plate and is bounded by the periphery to divide the plate into more than one section.

7. The plate of claim 5, further comprising a second wall being directly adjacent to the incline and rising above at least a portion of the incline surface, wherein the first wall and second wall form a channel across the incline surface.

8. The plate of claim 7, wherein the distance between at least one of the top of the first wall and the lower surface and the top of the second wall and the lower surface is greater than a distance between the upper surface and the lower surface.

9. The plate of claim 1 wherein the incline defines a surface that is substantially rectangular.

10. The plate of claim 1, wherein the lower surface includes a substantially flat portion and wherein the upper surface is substantially parallel to the flat portion of the lower surface.

11. A plate comprising:

a lower surface;

a lip formed about a periphery of the plate extending upwardly from the lower surface;

an upper surface located above the lower surface including a first side and a second side;

an incline extending from the lower surface of the plate to the first side of the upper surface, the incline defining a surface having a width;

a wall section extending from the second side of the upper surface to the lower surface of the plate, the wall section being substantially perpendicular to the upper surface and the lower surface of the plate;

a terminating wall extending upwardly from the lower surface;

at least two guiding inclines extending from the lower surface to the terminating wall, at least one of the at least two guiding inclines being configured to engage at least one interior tine of a fork; and wherein the wall section defines a cavity configured to receive a spoon, wherein a width of the cavity is substantially similar to the width of the surface of the incline and a width of the upper surface.

12. The plate of claim 11, further comprising a first wall, wherein the incline is adjacent to a first side of the first wall and the at least one guiding incline is adjacent to a second side of the first wall.

13. The plate of claim 12, further comprising a second wall directly adjacent to the incline and rising above at least a portion of the surface of the incline, wherein the first wall and second wall form a channel across the incline surface.

14. The plate of claim 12, wherein the terminating wall extends from the periphery along the lower surface to the first wall.

* * * * *